US008045866B2

(12) United States Patent
Eden et al.

(10) Patent No.: US 8,045,866 B2
(45) Date of Patent: Oct. 25, 2011

(54) HARD IMAGING METHODS, LIQUID MARKING AGENT MONITORING METHODS, AND HARD IMAGING DEVICES

(75) Inventors: Boaz Eden, Rehovot (IL); William D. Holland, Mountain View, CA (US); Omer Gila, Cuperino, CA (US); Moshe Peles, Lapid (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 1088 days.

(21) Appl. No.: 11/888,219

(22) Filed: Jul. 31, 2007

(65) Prior Publication Data

US 2009/0035670 A1 Feb. 5, 2009

(51) Int. Cl.
*G03G 15/08* (2006.01)

(52) U.S. Cl. ..... 399/30; 399/58

(58) Field of Classification Search ..... None
See application file for complete search history.

(56) References Cited

U.S. PATENT DOCUMENTS 4,008,612 A * 2/1977 Nagaoka et al. ..... 73/290 R
7,149,459 B2 12/2006 Kamijo et al.
7,151,906 B2 12/2006 Chou et al.
7,233,765 B2 6/2007 Murai et al.

OTHER PUBLICATIONS

"Hard Imaging Methods and Hard Imaging Devices"; Lee et al.; Filed Concurently; 27 pp.

* cited by examiner

*Primary Examiner* — David Gray
*Assistant Examiner* — Roy Y Yi

(57) ABSTRACT

Hard Imaging Methods, Liquid Marking Agent Monitoring Methods, and Hard Imaging Devices are described. According to one embodiment, a hard imaging method includes forming a plurality of latent images using a hard imaging device, using the hard imaging device, developing the latent images using a liquid marking agent, wherein bubbles are present in the liquid marking agent during the developing, calibrating the hard imaging device, and reducing bubbles present in the liquid marking agent during the calibrating compared with the bubbles present in the liquid marking agent during the developing. Additional embodiments are described in the disclosure.

21 Claims, 6 Drawing Sheets

HARD IMAGING METHODS, LIQUID MARKING AGENT MONITORING METHODS, AND HARD IMAGING DEVICES

FIELD OF THE DISCLOSURE

Aspects of the disclosure relate to hard imaging methods, liquid marking agent monitoring methods, and hard imaging devices.

BACKGROUND OF THE DISCLOSURE

Imaging devices capable of printing images upon paper and other media are ubiquitous and used in many applications including monochrome and color applications. For example, laser printers, ink jet printers, and digital printing presses are but a few examples of imaging devices in wide use today for monochrome or color imaging.

Electrophotographic imaging processes utilize a photoconductor which may be electrically charged and then selectively discharged to form latent images. The latent images may be developed and transferred to output media to form hard images upon the media. Electrophotographic imaging processes are implemented in laser printer configurations and digital presses in illustrative examples.

Imaging devices of example embodiments of the present disclosure use a liquid marking agent to develop latent images. At least some embodiments of the disclosure are directed towards apparatus and methods for monitoring the liquid marking agent and performing calibration operations. Additional embodiments are disclosed in the following disclosure.

SUMMARY

According to some aspects of the disclosure, hard imaging methods, liquid marking agent monitoring methods, and hard imaging devices are described.

According to one embodiment, a hard imaging method includes forming a plurality of latent images using a hard imaging device, using the hard imaging device, developing the latent images using a liquid marking agent, wherein bubbles are present in the liquid marking agent during the developing, calibrating the hard imaging device, and reducing bubbles present in the liquid marking agent during the calibrating compared with the bubbles present in the liquid marking agent during the developing.

According to another embodiment, a hard imaging device comprises a development assembly configured to develop a plurality of latent images using a liquid marking agent, a calibration assembly configured to perform calibration operations to calibrate the hard imaging device, and wherein the imaging device is configured to reduce bubbles present in the liquid marking agent during the calibration operations performed by the calibration assembly to calibrate the hard imaging device compared with bubbles present in the liquid marking agent during the development of the latent images.

Other embodiments are described as is apparent from the following discussion.

DESCRIPTION OF THE DRAWINGS

FIG. 6 is a graphical representation illustrating calibration operations of the hard imaging device according to one embodiment.

DETAILED DESCRIPTION

According to some embodiments of the disclosure, hard imaging devices and methods utilize a liquid marking agent to develop and form hard images. One form of a liquid marking agent comprises ink particles suspended in a liquid carrier, such as oil. One suitable liquid marking agent is Electroink® available from the Hewlett-Packard Company. During example development operations using a liquid marking agent, the liquid carrier and ink particles are applied to a photoconductor to develop latent images formed thereon and at least a substantial portion of the liquid carrier evaporates prior to transfer of the ink particles to media.

One or more properties (characteristics) of the marking agent may be monitored to provide and maintain acceptable print quality. Calibration operations may be performed in some embodiments to provide accurate monitoring of the properties. At least some embodiments of the disclosure provide apparatus and methods for performing calibration operations including calibration of monitoring of one or more of the properties of the liquid marking agent. As described below, at least one embodiment is configured to provide automatic operation where calibration is performed with reduced or no operator intervention.

Figure 1:
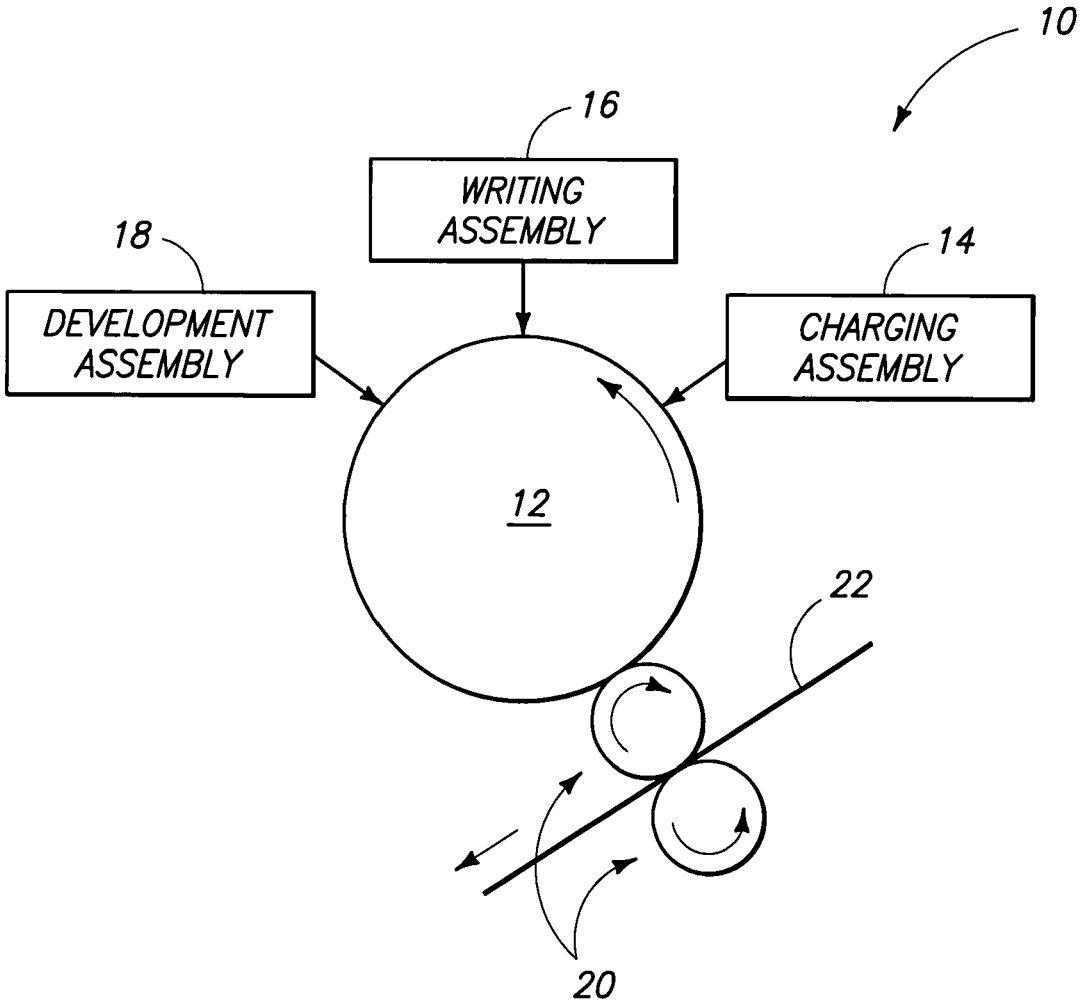
FIG. 1 is an illustrative representation of a hard imaging device according to one embodiment.

Referring to FIG. 1, an example of a hard imaging device 10 is shown according to one illustrative embodiment. The depicted arrangement of the hard imaging device 10 is configured to implement electrophotographic imaging wherein latent images are developed to form developed images which are subsequently transferred to output media. Examples of hard imaging devices 10 include digital presses (e.g., Indigo® presses available from the Hewlett-Packard Company) although other configurations may be used.

The hard imaging device 10 depicted in FIG. 1 includes a photoconductor 12, charging assembly 14, writing assembly 16, development assembly 18, and a transfer assembly 20. Hard imaging device 10 is configured to form hard images upon media 22, such as paper or other suitable imaging substrates. Other hard imaging devices 10 may include more, less or alternative components or other arrangements in other embodiments.

In one operational embodiment, charging assembly 14 is configured to deposit a blanket electrical charge upon substantially an entirety of an outer surface of photoconductor 12. Writing assembly 16 is configured to discharge selected portions of the outer surface of the photoconductor 12 to form latent images. Development assembly 18 is configured to provide a marking agent to the outer surface of photoconductor 12 to develop the latent images formed thereon. In one embodiment, the marking agent is a liquid marking agent. Ink particles of the liquid marking agent may be electrically charged to the same electrical polarity as the blanket charge provided to the outer surface of the photoconductor 12 and attracted to the discharged portions of the outer surface of the photoconductor 12 corresponding to the latent images to develop the latent images. The developed images are transferred by transfer assembly 20 to media 22.

Figure 2:
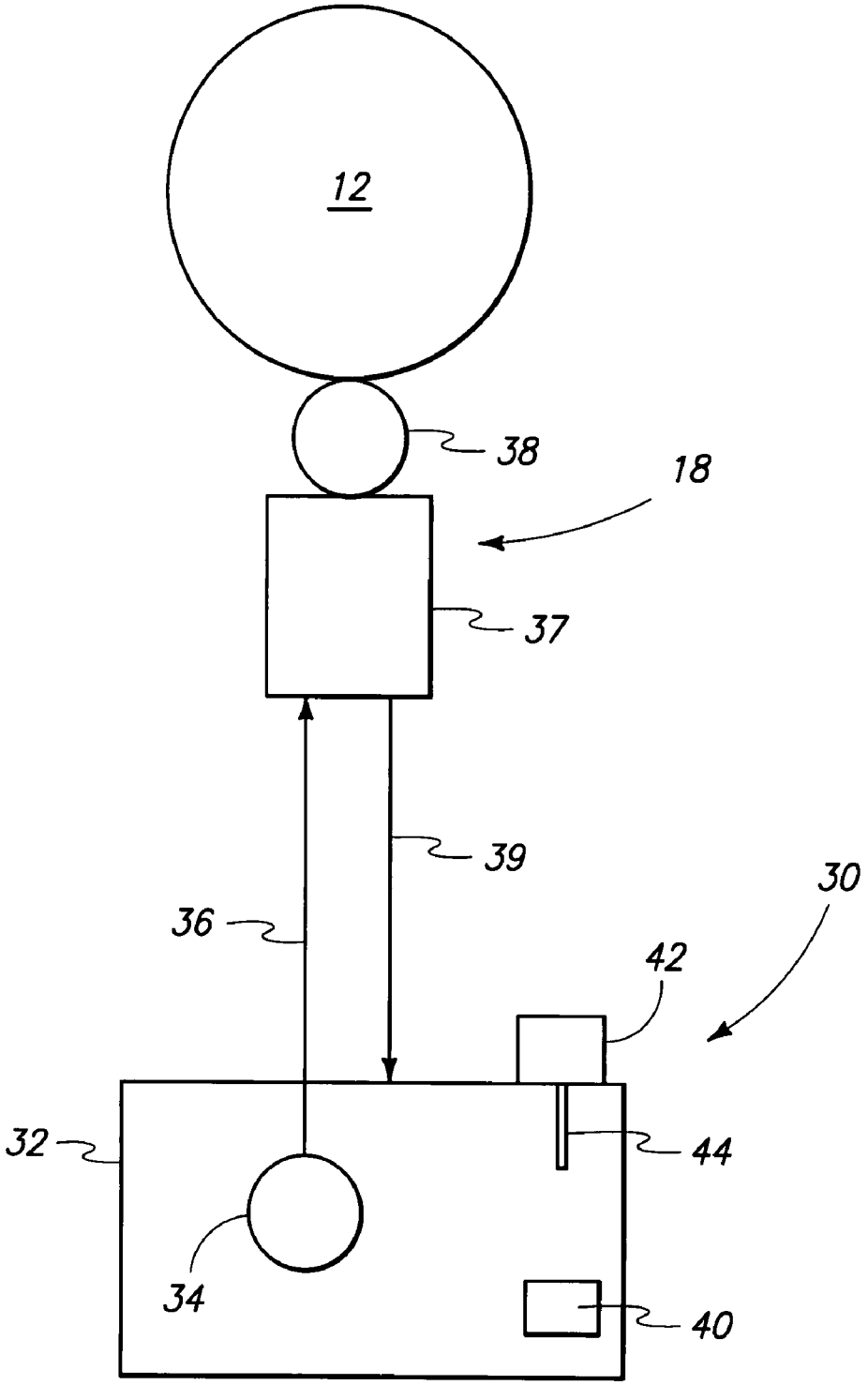
FIG. 2 is an illustrative representation of development operations of the hard imaging device according to one embodiment.

Referring to FIG. 2, additional details of one embodiment of development assembly 18 are shown with respect to a toner supply assembly 30 of hard imaging device 10. A single arrangement of assemblies 18, 30 of FIG. 2 may be used for monochrome hard imaging devices 10. In addition, a plurality of the arrangements of assemblies 18, 30 of FIG. 2 may be used for individual ones of the colors of color hard imaging devices 10.

Toner supply assembly 30 is configured to provide marking agent to development assembly 18 during imaging operations. Toner supply assembly 30 includes a reservoir 32 which contains a supply of the liquid marking agent in the presently described embodiment. A pump 34 is provided to transport the liquid marking agent from reservoir. 32 via a supply hose 36 to a chamber 37 of development assembly 18. A suitable pump 34 has HP designation HPPN CA245-01011. Development assembly 18 may contain a roller 38 or other appropriate device for providing the liquid marking agent from the chamber 37 to the outer surface of photoconductor 12 to develop latent images. Unused marking agent is returned to reservoir 32 via a return hose 39 in the depicted embodiment.

One or more properties (characteristics) of the marking agent may be monitored to provide or maintain acceptable print quality. Examples of the monitored properties include physical properties of a liquid marking agent. In more specific examples, one or more density, conductivity and temperature are monitored. Operations may be performed responsive to the monitoring to maintain the properties of a liquid marking agent within acceptable levels. In one embodiment, additives (e.g., ink particles, carrier fluid) may be added to the liquid marking agent in reservoir 32 responsive to monitoring of the liquid marking agent by sensors 40, 42. For example, an amount of ink particles in a liquid marking agent may be controlled to maintain an appropriate density of the liquid marking agent. In one embodiment, an acceptable density range of liquid marking agent for use in imaging is approximately 2% ink density but ink of other densities may be provided depending upon color, ink type, and state of device 10. Adjustments may be made to maintain the temperature of the liquid marking agent within an acceptable range (e.g., 29.5-31 degrees Celsius in one embodiment).

In one embodiment, toner supply assembly 30 may include a plurality of sensors 40, 42 configured to monitor the marking agent. In the embodiment of FIG. 2, the sensors 40, 42 are configured to monitor the characteristics (density, conductivity, temperature) and level of the marking agent within reservoir 32. In the depicted configuration, sensor 42 is positioned externally of reservoir 32 and has a probe 44 which extends into reservoir 32. Sensor 40 may be used to monitor the marking agent during development of latent images and may be referred to as an imaging sensor. However, the accuracy of sensor 40 may drift over time and calibration may be performed. Sensor 42 may be used during calibration operations to calibrate output of sensor 40 inasmuch as the accuracy of sensor 40. Other embodiments or arrangements for monitoring the liquid marking agent are possible.

As mentioned above, sensor 40 is used in one embodiment to monitor the marking agent during imaging operations. For example, sensor 40 may monitor one or more characteristic of the marking agent during supply of the marking agent to development assembly 18 and development of latent images upon photoconductor 12 using the marking agent. A suitable sensor 40 has HP designation HPPN CA256-00370.

In one embodiment, sensor 42 is a component of a calibration assembly configured to implement calibration operations to calibrate the hard imaging device 10. For example, sensor 42 may be used to calibrate monitoring of the marking agent performed by sensor 40. Calibration operations may be performed in some embodiments to provide increased accuracy of monitoring of the properties of the marking agent compared with arrangements wherein calibration is not performed. In one embodiment, monitoring of the marking agent by sensor 42 is performed during calibration operations of hard imaging device 10 while development of latent images is not performed. In one example of hard imaging device 10 comprising a digital press, calibration operations may be performed at weekly or monthly intervals (or at other times when appropriate).

Sensor 42 has increased accuracy for monitoring one or more characteristic of the liquid marking agent compared with monitoring by sensor 40 in one embodiment. In one calibration example, sensors 40, 42 both monitor the same characteristic(s) of the marking agent and the output of sensor 40 may be altered to match the output of sensor 42 for the respective characteristic(s). Other calibration operations are possible.

As mentioned above, sensor 42 may provide increased accuracy of monitoring of the marking agent compared with monitoring of the marking agent by sensor 40. Accordingly, sensor 42 may be used to calibrate monitoring of the liquid marking agent by sensor 40. However, some embodiments of sensor 42 may have difficulty providing accurate readings of a liquid marking agent when bubbles are present in the liquid marking agent. For example, one embodiment of sensor 42 configured to utilize ultra sonic sensing technology has increased sensitivity to bubbles which may be present in liquid marking agent compared with one embodiment of sensor 40 configured to utilize optical sensing technology.

As described further below, bubbles may be caused by imaging operations of the hard imaging device 10 and be present in the marking agent during the imaging operations to form hard images including development operations. Accordingly, it is desired in at least one embodiment to reduce the presence of bubbles in the liquid marking agent during calibration operations of sensor 40 compared with bubbles present when calibration is not occurring, for example, during imaging operations to form hard images including development of latent images.

In one example, bubbles may be caused by pumping operations of pump 34 and operations of development assembly 18. Additional details regarding formation of bubbles in liquid marking agent and reduction of the bubbles while hard imaging upon media occurs are described in a co-pending U.S. patent application entitled "Hard Imaging Devices and Hard Imaging Methods", naming Michael Lee, Quang Lam and Barry Oldfield as inventors, assigned to the assignee hereof, filed the same day as the present application, and the teachings of which are incorporated by reference herein. The output of some sensor configurations which are sensitive to the presence of bubbles in the liquid marking agent may be inaccurate, unreliable or otherwise unsuitable for usage in calibration of sensor 40 when bubbles are present.

In example embodiments of the disclosure, methods and apparatus are disclosed to reduce the number of bubbles present in the liquid marking agent during monitoring of the marking agent by sensor 42 for calibration purposes compared with the number of bubbles present during imaging operations including development of latent images. As mentioned above, one source of bubbles is caused by liquid marking agent entering the chamber 37 of development assembly 18 and then the liquid marking agent having bubbles entrapped therein is returned to reservoir 32 wherein sensors 40, 42 are positioned to monitor the marking agent. In one embodiment, the supply of liquid marking agent to chamber 37 of development assembly 18 is ceased during calibration operations to reduce the number of bubbles present in the liquid marking agent.

In one more specific example, pump 34 may be triggered or cycled on and off during calibration operations. In one embodiment, the cycling of pump 34 may be implemented to prevent supply of the marking agent to chamber 37 of development assembly 18 to reduce or eliminate bubbles resulting from the supply of the marking agent to chamber 37. In one implementation, the on period of the pump 34 is controlled to be less than the off period during a cycling period. In one embodiment, the on and off periods of time are chosen such that marking agent is drawn partially into supply hose 36 during the pumping of pump 34 but the pumping of the pump 34 ceases prior to entry of the marking agent into chamber 37. The marking agent present in supply hose 36 is returned to reservoir 32 by gravity when the pump 34 is turned off in one configuration of hard imaging device 10 where development assembly 18 is placed elevationally above reservoir 32. In another embodiment, a barrier, such as a valve (not shown), may be provided in supply hose 36 to prevent liquid marking agent from reaching the chamber 37. A control system of the calibration assembly described below may be configured to adjust or close the valve to prevent the liquid marking agent from reaching the chamber 37 during calibration operations in one implementation.

Cycling of pump 34 during calibration operations is beneficial inasmuch as the traveling of the marking agent up and down supply hose 36 operates to stir or otherwise mix the marking agent. Accordingly, liquid marking agent within reservoir 32 is substantially homogenous during example calibration operations. In one example, it is not desired to turn pump 34 off for extended periods during calibration operations since ink particles present in a liquid marking agent may settle adding error to monitoring of the marking agent. Pump cycling may be performed at a certain ratio for a suitable period of time (e.g., 3-5 minutes) in one configuration of hard imaging device 10. An on time of 100 ms and an off time of 2.5 seconds were utilized in one embodiment where supply hose 36 is approximately one meter in length. Other implementations are possible in other configurations of hard imaging device 10.

In another embodiment, operational parameters of pump 34 other than or in addition to the above-mentioned cycling may be controlled to reduce the presence of bubbles in the marking agent during calibration. It has been observed that operation of pump 34 inside of reservoir 32 may create bubbles. In one example, an operational frequency of pump 34 may be reduced during calibration operations (compared with an operational frequency used during imaging operations wherein latent images are developed) to reduce the formation of bubbles in the marking agent present in reservoir 32 and caused by pump 34. In one more specific example, pump 34 stirs and pumps liquid marking agent present in reservoir 32 at a default frequency of 74 Hz during development operations (and which contributes to formation of bubbles, in the liquid marking agent) and at a frequency of 50 Hz during calibration to reduce the presence of bubbles during calibration. Other pump operational frequencies may be used in other embodiments. Thereafter, following calibration, the pump operational frequency may be increased to resume imaging operations including development of latent images.

Figure 3:
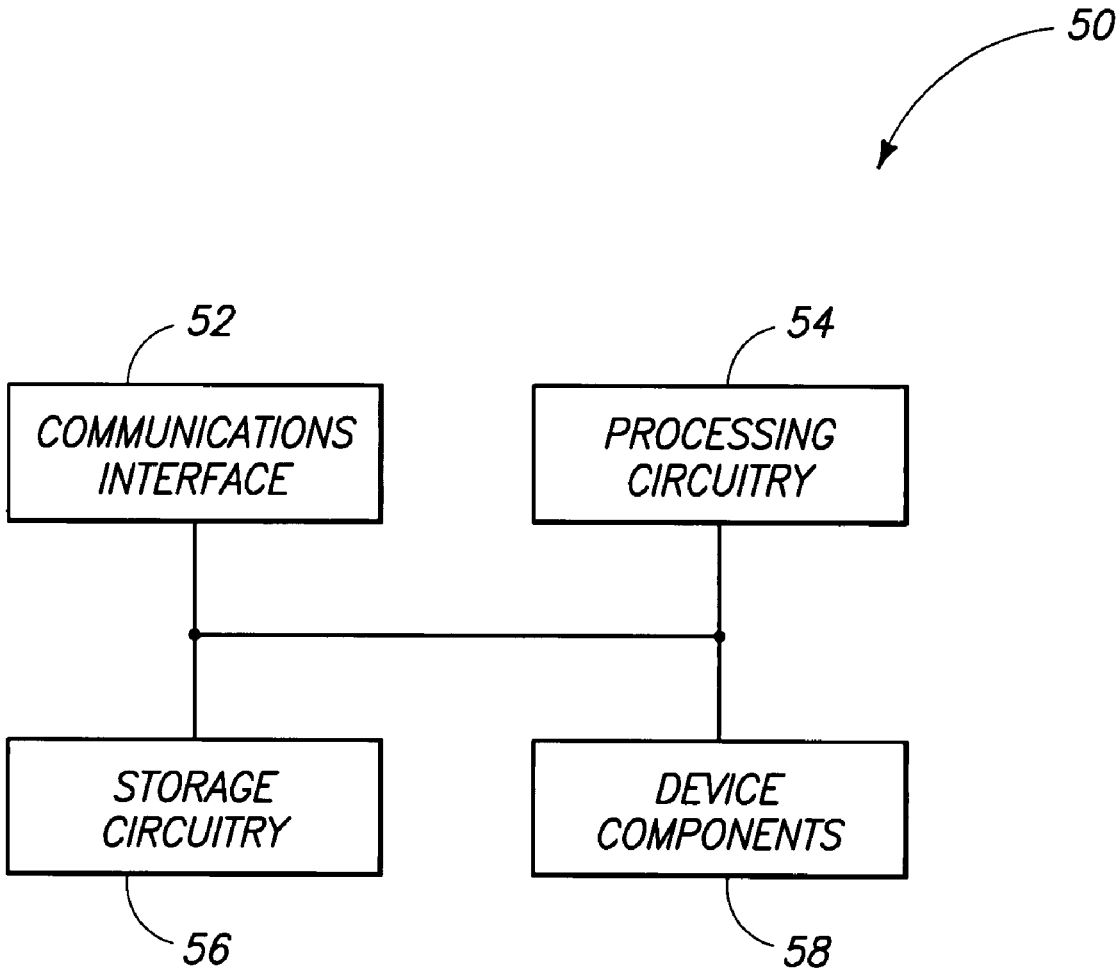
FIG. 3 is a functional block diagram of circuitry of the hard imaging device according to one embodiment.

Referring to FIG. 3, an example of electrical components of hard imaging device 10 are illustrated according to one embodiment. The electrical components include a communications interface 52, processing circuitry 54, storage circuitry 56 and device components 58 in one embodiment of hard imaging device 10. More, less or alternative components are provided in other embodiments of hard imaging device 10.

Communications interface 52 is arranged to implement communications of hard imaging device 10 with respect to external devices (not shown). For example, communications interface 52 may be arranged to communicate information bi-directionally with respect to device 10. Communications interface 12 may be implemented as a network interface card (NIC), serial or parallel connection, USB port, Firewire interface, flash memory interface, floppy disk drive, or any other suitable arrangement for communicating with respect to device 10. In one example, image data of hard images to be formed may be received by communications interface 52.

In one embodiment, processing circuitry 54 is arranged to process data, control data access and storage, issue commands, and control other desired operations of device 10 including imaging and calibration operations. Processing circuitry 54 may comprise circuitry configured to implement desired programming provided by appropriate media in at least one embodiment. For example, the processing circuitry 54 may be implemented as one or more of a processor and/or other structure configured to execute executable instructions including, for example, software and/or firmware instructions, and/or hardware circuitry. Exemplary embodiments of processing circuitry 54 include hardware logic, PGA, FPGA, ASIC, state machines, and/or other structures alone or in combination with a processor. These examples of processing circuitry 54 are for illustration and other configurations are possible.

The storage circuitry 56 is configured to store programming such as executable code or instructions (e.g., software and/or firmware), electronic data, databases, image data, or other digital information and may include processor-usable media. Processor-usable media may be embodied in any computer program product(s) or article of manufacture(s) which can contain, store, or maintain programming, data and/or digital information for use by or in connection with an instruction execution system including processing circuitry in the exemplary embodiment. For example, exemplary processor-usable media may include any one of physical media such as electronic, magnetic, optical, electromagnetic, infrared or semiconductor media. Some more specific examples of processor-usable media include, but are not limited to, a portable magnetic computer diskette, such as a floppy diskette, zip disk, hard drive, random access memory, read only memory, flash memory, cache memory, and/or other configurations capable of storing programming, data, or other digital information.

At least some embodiments or aspects described herein may be implemented using programming stored within appropriate storage circuitry 56 described above and/or communicated via a network or other transmission media and configured to control appropriate processing circuitry. For example, programming may be provided via appropriate media including, for example, embodied within articles of manufacture. In another example, programming may be embodied within a data signal (e.g., modulated carrier wave, data packets, digital representations, etc.) communicated via an appropriate transmission medium, such as a communication network (e.g., the Internet and/or a private network), wired electrical connection, optical connection and/or electromagnetic energy, for example, via a communications interface, or provided using other appropriate communication structure. Exemplary programming including processor-usable code may be communicated as a data signal embodied in a carrier wave in but one example.

Device components 58 include additional electrical components of the hard imaging device 10. For example, device components 58 may include sensors 40, 42, pump 34, motors (not shown), a user interface, and other additional electrical components and which may be controlled or monitored by processing circuitry 54.

In one embodiment, processing circuitry 54 operates as a control system to control imaging operations of hard imaging device 10 to form hard images. In addition, processing circuitry 54 may function as a control system of the calibration assembly. With respect to one example calibration embodiment, processing circuitry 54 may determine moments in time when calibration should be performed. Processing circuitry 54 may control device 10 to cease imaging operations during calibration in one embodiment. Furthermore, processing circuitry 54 may control calibration operations of device 10 and may control operations of hard imaging device 10 to reduce the number of bubbles present in the liquid marking agent during calibration in one embodiment. For example, processing circuitry 54 may reduce the operational frequency of pump 34 and/or cycle pump 34 to implement calibration operations.

Processing circuitry 54 may additionally access data resulting from the monitoring of the characteristics of the liquid marking agent by sensor 42 during calibration. If appropriate, the processing circuitry 54 may calibrate sensor 40 using the monitored data. In one embodiment, processing circuitry 54 operating as the control system may automatically perform the calibration operations including reducing the presence of bubbles, monitoring the liquid marking agent using sensor 42 and calibrating sensor 40 with reduced or no operator intervention. In one embodiment, the described process for calibrating sensor 40 may be performed in a relatively short period of time, such as approximately 2 minutes. The above operations of processing circuitry 54 are examples and more, less or additional calibration operations may be controlled by processing circuitry 54.

Figure 4:
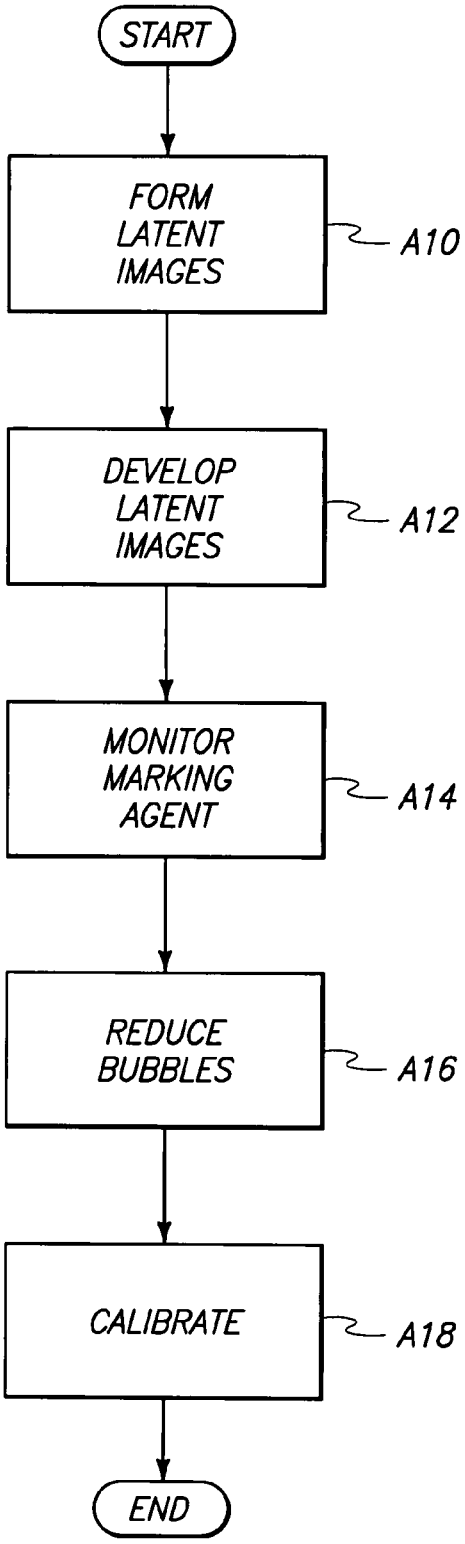
FIG. 4 is a flow chart of one operational method of a hard imaging device according to one embodiment.

Referring to FIG. 4, a method performed by hard imaging device 10 is illustrated according to one embodiment. Processing circuitry 54 is configured to perform the depicted acts according to one embodiment. Other methods are possible including more, less or alternative acts.

At an Act A10, latent images are formed upon a photoconductor in accordance with normal imaging operations to form hard images.

At an Act A12, the latent images are developed using a liquid marking agent in the described example.

At an Act A14, the liquid marking agent may be monitored during the imaging operations to form the hard images, for example, during the development of Act A12.

At an Act A16, a moment in time is determined where calibration of the hard imaging device is appropriate. In one embodiment, calibration operations are performed to calibrate a sensor configured to perform Act A14 including the monitoring of the liquid marking agent during imaging operations to form the hard images. At Act A16, one or more operation of the hard imaging device may be modified to reduce a presence of bubbles in the liquid marking agent in preparation of the calibration operations.

At an Act A18, calibration operations are performed, for example, with respect to the sensor configured to perform Act A14: In one example, an additional sensor as described above may monitor the liquid marking agent while reduced bubbles are provided in the liquid marking agent. The output of the additional sensor may be used to calibrate the sensor which performs the monitoring of Act A14. Hard imaging operations may be resumed wherein latent images are developed following the calibration of Act A18.

Figure 5:
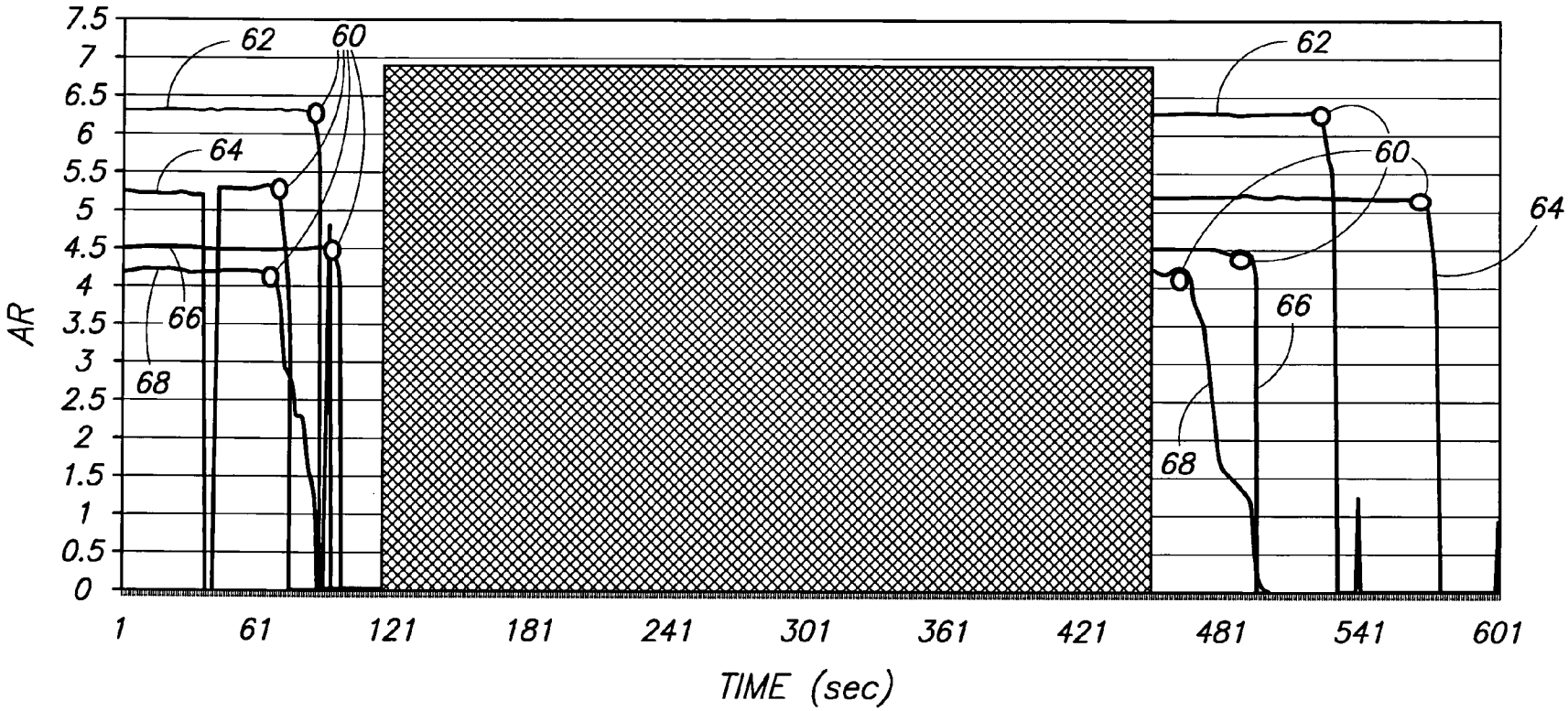
FIG. 5 is a graphical representation illustrating calibration operations of the hard imaging device according to one embodiment.
Figure 11:
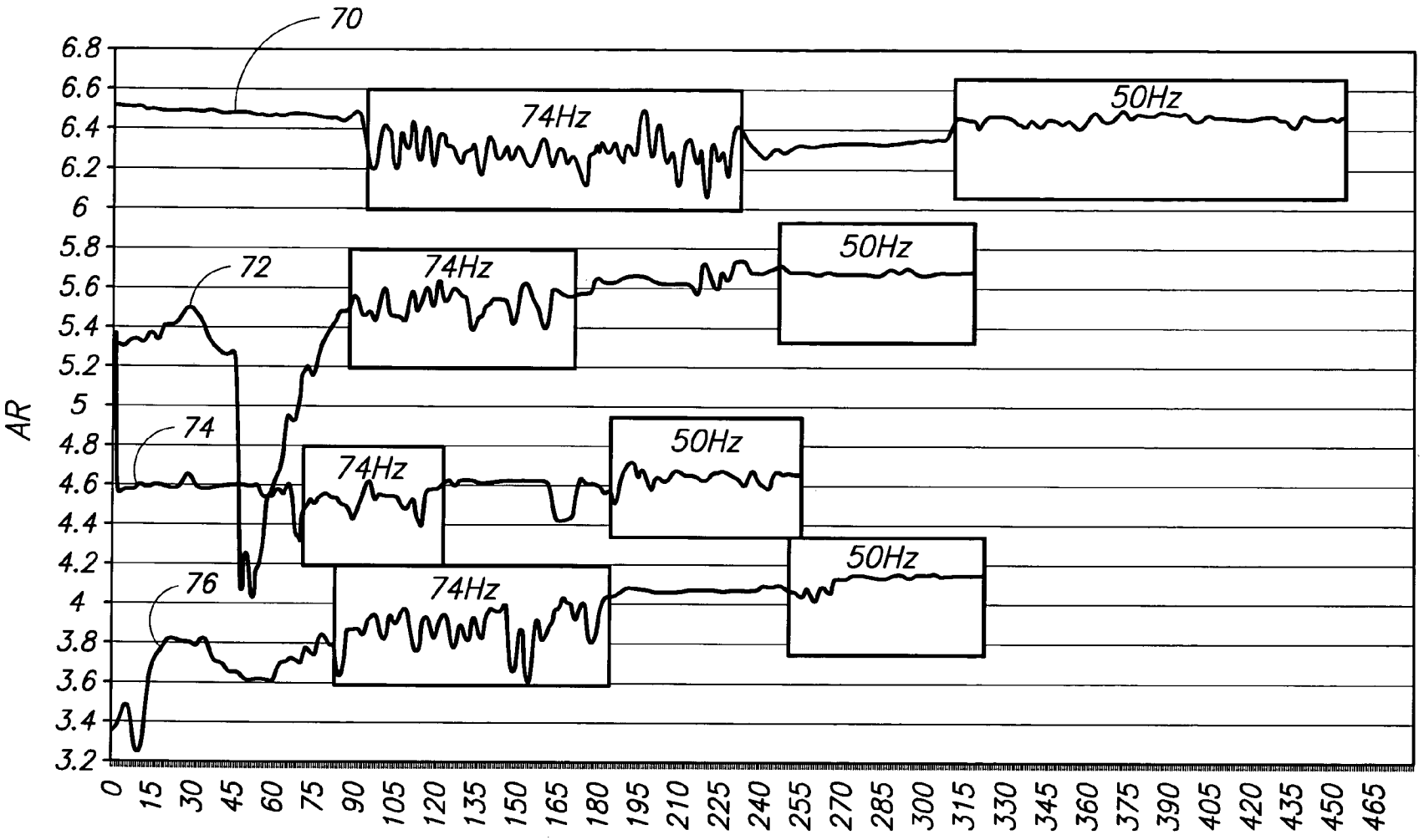

Referring to FIG. 5, a graphical representation of cycling of pump 34 is shown according to one embodiment. The graphical representation shows amplitude ratio (AR) based upon monitoring of sensor 42 versus time. Amplitude ratio (AR) and time difference (dT) are two factors which may be used in order to evaluate ink density in one embodiment. A plurality of points 60 are shown corresponding to turning on of pump 34 and a plurality of different ink solution concentrations of the liquid marking agent are represented by lines 62, 64, 66, 68. In one embodiment, lines 62, 64, 66, 68 correspond to liquid marking agents having a percent non-volatile solids (% NVS) of ink particles of 3%, 2%, 1%, 0%, respectively. FIG. 5 also shows pump cycling according to one embodiment during a time period of approximately 121-460 seconds. As shown in FIG. 5, the signals of lines 62, 64, 66, 68 drop to zero following turning on of pump 34 at points 60. However, the signals stabilize after the cycling of pump 34 as shown indicating a reduction of bubbles in the liquid marking agent and permitting calibration operations to be performed, for example, at a time corresponding to 460 seconds.

Referring to FIG. 6, a graphical representation of adjustment of an operational frequency of pump 34 is shown according to one embodiment with supply hose 36 closed. The graphical representation shows amplitude ratio (AR) based upon monitoring of sensor 42 versus time. A plurality of different ink solution concentrations of the liquid marking agents are represented by lines 70, 72, 74, 76 corresponding to liquid marking agents having a percent non-volatile solids of ink particles (% NVS) of 3%, 2%, 1%, 0%, respectively. FIG. 6 shows operation of pump 34 at different operational frequencies of 50 Hz and 74 Hz showing increased stability in the output of sensor 42 at the reduced operational frequency of 50 Hz indicating a reduction of bubbles in the liquid marking agent.

At least some embodiments of the disclosure are directed towards calibration operations of hard imaging device 10 to provide or maintain acceptable print quality. One or more property or characteristic of a liquid marking agent (e.g., density, temperature, conductivity) may be monitored and calibrated in one embodiment. At least some aspects of the disclosure provide reduced bubbles in the liquid marking agent which enables sensors of increased accuracy or precision to be used for calibration of the monitoring operations of the liquid marking agent.

Some of the example embodiments of the disclosure provide ease of use since the process is clean and operators do not open supply hoses carrying liquid marking agents, access other parts of the ink system, or manually install barriers in the supply hose to perform calibration operations. Some aspects of the disclosure provide automatic operation with reduced or no human intervention in measurement and calibration and which may provide calibration operations of increased accuracy. Furthermore, apparatus and methods of some embodiments of the disclosure may be retrofitted to many exiting hard imaging device configurations.

Further, aspects herein have been presented for guidance in construction and/or operation of illustrative embodiments of the disclosure. Applicant(s) hereof consider these described illustrative embodiments to also include, disclose and describe further inventive aspects in addition to those explicitly disclosed. For example, the additional inventive aspects may include less, more and/or alternative features than those described in the illustrative embodiments. In more specific examples, Applicants consider the disclosure to include, disclose and describe methods which include less, more and/or alternative acts than those methods explicitly disclosed as well as apparatus which includes less, more and/or alternative structure than the explicitly disclosed structure.

The protection sought is not to be limited to the disclosed embodiments, which are given by way of example only, but instead is to be limited only by the scope of the appended claims.

What is claimed is:

1. A hard imaging method comprising:

forming a latent image using a hard imaging device;

developing the latent image using a liquid marking agent, wherein bubbles are present in the liquid marking agent during the developing;

calibrating the hard imaging device;

reducing bubbles present in the liquid marking agent during the calibrating compared with the bubbles present in the liquid marking agent during the developing; and monitoring a characteristic of the liquid marking agent during formation of the latent image using the hard imaging device, wherein the calibrating comprises calibrating the monitoring, the monitoring comprises first monitoring using a first sensor, the calibrating further comprises second monitoring the characteristic using a second sensor to calibrate the first sensor, and the second sensor has an increased degree of accuracy for monitoring the characteristic of the liquid marking agent compared with the first sensor and an increased sensitivity to the presence of bubbles in the liquid marking agent compared with the first sensor.

2. The method of claim 1 further comprising:

transferring the liquid marking agent into a development assembly during the developing; and discontinue transferring the liquid marking agent into the development assembly to reduce the bubbles present in the liquid marking agent during the calibrating.

3. The method of claim 1 further comprising:

transferring the liquid marking agent from a reservoir to a development assembly using a pump during the developing; and cycling the pump on and off during the calibrating to reduce the bubbles present in the liquid marking agent during the calibrating.

4. The method of claim 3 wherein the cycling mixes the liquid marking agent in the reservoir and the calibrating comprises monitoring the liquid marking agent in the reservoir.

5. The method of claim 1 further comprising:

transferring the liquid marking agent to a development assembly during the developing using a pump operating at a first frequency; and operating the pump at a second frequency different than the first frequency during the calibrating to reduce the bubbles present in the liquid marking agent during the calibrating.

6. The method of claim 1 wherein the liquid ink marking agent comprises ink particles suspended in a liquid carrier.

7. A liquid marking agent monitoring method comprising:

first monitoring of a liquid marking agent at a first time during development of a latent image using a hard imaging device;

second monitoring of the liquid marking agent at a second time to calibrate the first monitoring of the liquid marking agent; and reducing bubbles present in the liquid marking agent during the second monitoring relative to bubbles present in the liquid marking agent during the first monitoring, wherein the first monitoring and the second monitoring comprise monitoring a characteristic of the liquid marking agent using respective ones of a first sensor and a second sensor, and further comprising calibrating the first sensor using the second monitoring by the second sensor.

8. The method of claim 7 further comprising:

transferring the liquid marking agent into a development assembly of the hard imaging device during the development of the latent image, wherein the first monitoring comprises monitoring during the transferring of the liquid marking agent into the development assembly; and discontinue transferring the liquid marking agent into the development assembly during the second monitoring to reduce the bubbles present in the liquid marking agent during the calibrating.

9. The method of claim 7 further comprising:

transferring the liquid marking agent into a development assembly of the hard imaging device using a pump during the development of the latent image; and cycling the pump on and off to reduce the bubbles present in the liquid marking agent during the calibrating.

10. The method of claim 7 further comprising:

transferring the liquid marking agent to a development assembly of the hard imaging device using a pump operating at a first frequency during the development of the latent images, wherein the first monitoring occurs during the transferring; and operating the pump at a second frequency different from the first frequency during the second monitoring to reduce the bubbles present in the liquid marking agent during the calibrating.

11. A hard imaging device comprising:

a development assembly to develop a latent image using a liquid marking agent;

a first sensor to monitor the liquid marking agent during the development of the latent image;

a calibration assembly to perform a calibration operation to calibrate the first sensor, the calibration assembly having a second sensor to monitor the liquid marking agent during the calibration operation, the first sensor to be calibrated using the second sensor, the second sensor having an increased degree of accuracy for monitoring the characteristic of the liquid marking agent compared with the first sensor and an increased sensitivity to the presence of bubbles in the liquid marking agent compared with the first sensor; and a processor programmed to control an operation of the development assembly to reduce bubbles present in the liquid marking agent during the calibration operation performed by the calibration assembly to calibrate the hard imaging device compared with bubbles present in the liquid marking agent during the development of the latent image.

12. The device of claim 11 wherein the processor is to discontinue providing of the liquid marking agent to the development assembly during the calibration operation performed by the calibration assembly.

13. The device of claim 11 further comprising a pump to supply the liquid marking agent for use in the development of the latent image, and wherein the pump is cycled on and off to reduce the bubbles present in the liquid marking agent during the calibration operation.

14. The device of claim 11 further comprising a pump to operate at a first frequency to supply the liquid marking agent for use in the development of the latent image, and wherein pump is to operate at a second frequency different than the first operational frequency to reduce the bubbles present in the marking agent during the calibration operation.

15. The device of claim 11 wherein the calibration assembly is to perform the calibration operation when development of the latent image by the development assembly is not occurring.

16. A tangible article of manufacture comprising a machine-readable storage medium storing machine-readable instructions that, when executed, cause a processor to at least:

form a latent image using a hard imaging device, the latent image formed using a liquid marking agent, wherein bubbles are present in the liquid marking agent during developing;

calibrate the hard imaging device;

reduce bubbles present in the liquid marking agent during the calibrating relative to the bubbles present in the liquid marking agent during the developing;

monitor a characteristic using a first sensor; and calibrate the first sensor using a second sensor having an increased sensitivity to the characteristic of the liquid marking agent compared with the first sensor and an increased sensitivity to the presence of bubbles in the liquid marking agent compared with the first sensor.

17. The tangible article of manufacture of claim 16, wherein the machine-readable instructions, when executed, cause the processor to monitor a characteristic of the liquid marking agent during formation of the latent image using the hard imaging device, and to calibrate the hard imaging device by calibrating the monitoring.

18. The tangible article of manufacture of claim 16, wherein the machine-readable instructions, when executed, cause the processor to:

transfer the liquid marking agent into a development assembly during the developing; and discontinue the transferring of the liquid marking agent into the development assembly to reduce the bubbles present in the liquid marking agent during the calibrating.

19. The tangible article of manufacture of claim 16, wherein the machine-readable instructions, when executed, cause the processor to:

transfer the liquid marking agent from a reservoir to a development assembly using a pump during the developing; and cycle the pump on and off during the calibrating to reduce the bubbles present in the liquid marking agent during the calibrating.

20. The tangible article of manufacture of claim 16, wherein the machine-readable instructions, when executed, cause the processor to:

transfer the liquid marking agent to a development assembly during the developing using a pump operating at a first frequency; and operate the pump at a second frequency different from the first frequency during the calibrating to reduce the bubbles present in the liquid marking agent during the calibrating.

21. The tangible article of manufacture of claim 16, wherein the liquid ink marking agent comprises ink particles suspended in a liquid carrier.

* * * * *